US009790611B2

(12) United States Patent
Yoshida et al.

(10) Patent No.: US 9,790,611 B2
(45) Date of Patent: Oct. 17, 2017

(54) PARTIAL ANODIZING APPARATUS AND ANODIZING METHOD USING THE SAME

(71) Applicant: AISIN KEIKINZOKU CO., LTD., Imizu-shi, Toyama (JP)

(72) Inventors: Arata Yoshida, Toyama (JP); Jin Shinmura, Toyama (JP)

(73) Assignee: Aisin Keikinzoku Co., Ltd. (JP)

( * ) Notice: Subject to any disclaimer, the term of this patent is extended or adjusted under 35 U.S.C. 154(b) by 77 days.

(21) Appl. No.: 14/387,373

(22) PCT Filed: Jan. 31, 2013

(86) PCT No.: PCT/JP2013/052135

§ 371 (c)(1),
(2) Date: Sep. 23, 2014

(87) PCT Pub. No.: WO2014/002520

PCT Pub. Date: Jan. 3, 2014

(65) Prior Publication Data

US 2015/0083603 A1 Mar. 26, 2015

(30) Foreign Application Priority Data

Jun. 29, 2012 (JP) ..... 2012-146843

(51) Int. Cl.
*C25D 11/02* (2006.01)
*C25D 11/00* (2006.01)

(52) U.S. Cl.
CPC ..... *C25D 11/022* (2013.01); *C25D 11/005* (2013.01)

(58) Field of Classification Search
CPC ..... C25D 11/005; C25D 11/022
See application file for complete search history.

(56) References Cited

U.S. PATENT DOCUMENTS 3,361,662 A * 1/1968 Sutch ..... C25D 11/005 204/224 R
3,546,088 A * 12/1970 Barkman et al. ..... 204/224 M
4,750,981 A * 6/1988 Dalland ..... C25D 5/02 204/224 R
8,888,983 B2 * 11/2014 Shawcross ..... A61L 27/04 205/199

(Continued)

FOREIGN PATENT DOCUMENTS

JP S63-190191 A 8/1988
JP H05-025693 A 2/1993

(Continued)

OTHER PUBLICATIONS

Perez, I., "Nanoporous AAO: A platform for regular heterogeneous nanostructures and energy storage devices", 2009.*

*Primary Examiner* — Stefanie S Wittenberg
(74) *Attorney, Agent, or Firm* — Harness, Dickey & Pierce, P.L.C.

(57) ABSTRACT

An apparatus and a method are disclosed that form an anodic oxide coating on part of the outer surface of a profile having an irregular cross-sectional shape. A partial anodizing apparatus that is used to partially anodize a profile having an irregular cross-sectional shape includes an electrolytic bath that is divided into two or more partial baths. The profile is held using the two or more partial baths so that part of the profile is situated outside the electrolytic bath to form a sealed electrolysis chamber.

2 Claims, 5 Drawing Sheets

(56) References Cited

U.S. PATENT DOCUMENTS

2011/0233053 A1* 9/2011 Kobayashi et al. ..... 204/275.1

FOREIGN PATENT DOCUMENTS

| | | | |
|---|---|---|---|
| JP | H08-269788 | A | 10/1996 |
| JP | H11-117092 | A | 4/1999 |
| JP | 2003-119593 | A | 4/2003 |
| JP | 2003-301295 | A | 10/2003 |
| JP | 2005-068458 | A | 3/2005 |
| JP | 2006-019317 | A | 1/2006 |

* cited by examiner

FIG. 1B VIEW A

FIG. 1C VIEW B

FIG. 5

| | | Treatment area ($dm^2$) | Stagnation | Flow rate (l/min) | Current density ($A/dm^2$) | Voltage application time (min) | Value 22SJ | Value 30V | Liquid temperature (℃) | Burning | Coating thickness ($\mu$m) | Corrosion ratio(%) |
|---|---|---|---|---|---|---|---|---|---|---|---|---|
| Example | 1 | 4. 6 | Not occurred | 40 | 10 | 4 | 1012 | 1200 | 20 | Not occurred | 10. 8 | 0 |
| | 2 | 4. 6 | Not occurred | 40 | 8 | 4 | 810 | 1200 | 20 | Not occurred | 8. 9 | 1 |
| | 3 | 16 | Not occurred | 125 | 10 | 4 | 3520 | 3750 | 20 | Not occurred | 12. 6 | 1 |
| Comparative Example | 1 | 4. 6 | Occurred | 30 | 8 | 4 | 810 | 900 | 20 | Occurred | — | — |
| | 2 | 16 | Not occurred | 45 | 12 | 4 | 4224 | 1350 | 20 | Occurred | — | — |

PARTIAL ANODIZING APPARATUS AND ANODIZING METHOD USING THE SAME

CROSS-REFERENCE TO RELATED APPLICATIONS

This application is a U.S. National Stage Application of International Application No. PCT/JP2013/052135 filed on Jan. 31, 2013, and published in Japanese as WO 2014/002520 A1 on Jan. 3, 2014. This application claims priority to Japanese Application No. 2012-146843 filed on Jun. 29, 2012. The entire disclosures of the above applications are incorporated herein by reference.

TECHNICAL FIELD

The present invention relates to an apparatus and a method for forming an anodic oxide coating on part of a profile that is formed of a light alloy such as an aluminum alloy or a magnesium alloy.

BACKGROUND ART

A profile (e.g., extruded profile) formed of aluminum or an alloy thereof (hereinafter referred to as "aluminum alloy") and having an irregular cross-sectional shape has been used in a wide variety of fields (e.g., building materials, vehicular parts, and daily commodities).

A profile formed of an aluminum alloy or the like is normally anodized in order to improve surface properties such as corrosion resistance and hardness.

However, since it may be unnecessary to form an anodic oxide coating over the entire surface of the profile, a method that forms an anodic oxide coating on part of the surface of the profile has been proposed.

For example, the Applicant of the present application proposed a method that quickly forms an anodic oxide coating on an aluminum alloy extruded profile having an irregular cross-sectional shape only within a specific range in the longitudinal direction (see JP-A-2005-68458).

On the other hand, the present invention was conceived to form an anodic oxide coating on part of the outer surface of a profile in a cross direction.

JP-A-5-25693 and JP-A-11-117092 and the like disclose a method that forms an anodic oxide coating only on the inner side of a hollow aluminum product. However, an apparatus and the like that partially anodize the outer surface of a profile having an irregular cross-sectional shape have not been proposed.

SUMMARY OF THE INVENTION

Technical Problem

An object of the invention is to provide an apparatus and a method that form an anodic oxide coating on part of the outer surface of a profile having an irregular cross-sectional shape.

Solution to Problem

According to one aspect of the invention, there is provided a partial anodizing method that partially anodizes a profile having an irregular cross-sectional shape using an electrolytic bath that includes a first partial bath and a second partial bath, the first partial bath having an approximately box-like shape, and being formed of an insulating material, a cathode being disposed on an inner side of the first partial bath, and the second partial bath having an approximately plate-like shape, and being formed of an insulating material, the method comprising:

disposing first part of the profile that does not form a design surface on the second partial bath through a seal member;

joining the first partial bath and the second partial bath to hold the profile so that second part of the profile is situated outside the electrolytic bath, an electrolysis chamber having inlets and outlets for an electrolyte solution being formed by joining the first partial bath and the second partial bath; and discharging the electrolyte solution through the inlets.

The term "irregular cross-sectional shape" used herein refers to a shape other than a simple axisymmetrical cross-sectional shape (e.g., plate or cylinder).

The term "profile" used herein refers to a wrought product other than that having a circular cross-sectional shape.

Since the electrolytic bath is divided into the first partial bath and the second partial bath, and the end of the first partial bath and the end of the second partial bath can be joined (connected) either directly or through the profile to hold the profile and form the electrolysis chamber, the electrolytic bath can be formed so that the surface of part of the profile faces the electrolysis chamber.

Therefore, part of the profile for which an anodic oxide coating is unnecessary can be positioned outside the electrolytic bath.

When joining two or more partial baths into which the electrolytic bath is divided, a seal member (seal section) may be provided to at least one partial bath so that the electrolyte solution does not reach part of the profile that is not anodized. In this case, the anodizing range can be limited to the desired part (e.g., design surface) of the profile.

When anodizing the profile in the electrolysis chamber that is formed as described above, the profile that is formed of an aluminum alloy or the like is used as an anode, and a cathode that is situated opposite to the anode is provided in the electrolysis chamber. A voltage is applied between the anode and the cathode so that an electrolytic current flows through the electrolysis chamber to form an anodic oxide coating on the surface of part of the profile.

Since heat is generated during anodizing, it is necessary to cool the electrolyte solution.

In order to efficiently cool the electrolyte solution, and prevent a situation in which local burning occurs on the anodizing target surface of the profile, it is preferable that the electrolysis chamber have inlets and outlets for the electrolyte solution, and be provided with an electrolyte solution circulation device that collects the electrolyte solution drained through the outlets, and discharges the collected electrolyte solution through the inlets.

According to this configuration, the electrolyte solution can be collected when placing or removing the profile by separating the electrolytic bath into the partial baths, and it is possible to prevent a situation in which the electrolyte solution stagnates in part of the electrolysis chamber and local burning occurs on the anodizing target surface of the profile, by providing the inlets and the outlets at equal intervals.

In the partial anodizing method, the profile is preferably anodized so that $22SJ<30V$ is satisfied, S being a treatment area ($dm^2$) in which the profile is partially anodized, J being an electrolysis current density ($A/dm^2$), and V being a flow rate (1/min) of the electrolyte solution that is circulated through the electrolysis chamber.

Since the flow rate of the electrolyte solution affects removal of heat generated during electrolysis, the flow rate of the electrolyte solution that is circulated through the electrolysis chamber is controlled.

Advantageous Effects of the Invention

The outer surface of the profile can be partially anodized while providing an excellent design surface by utilizing the partial anodizing apparatus according to the invention.

BRIEF DESCRIPTION OF DRAWINGS

FIGS. 1A to 1C illustrate an example of the structure of an electrolytic bath according to one embodiment of the invention, wherein FIG. 1A is a cross-sectional view, FIG. 1B is a view A, and FIG. 1C is a view B.

FIG. 5 shows evaluation sample preparation conditions and evaluation results.

DESCRIPTION OF EMBODIMENTS

Figure 1A:
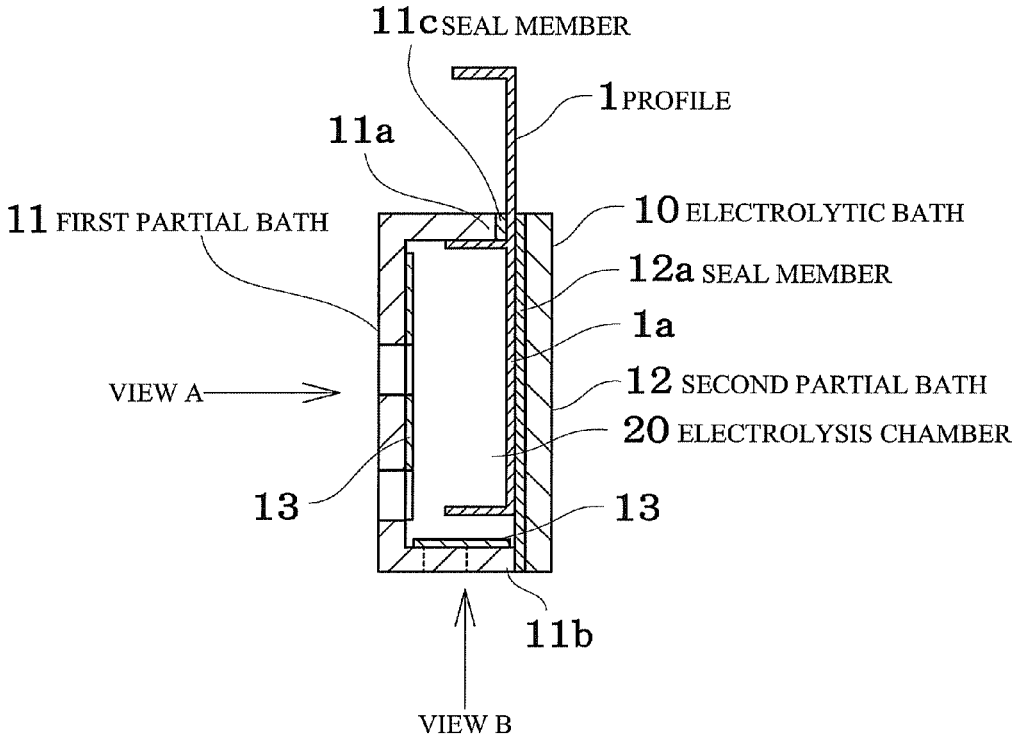
Figure 1A:
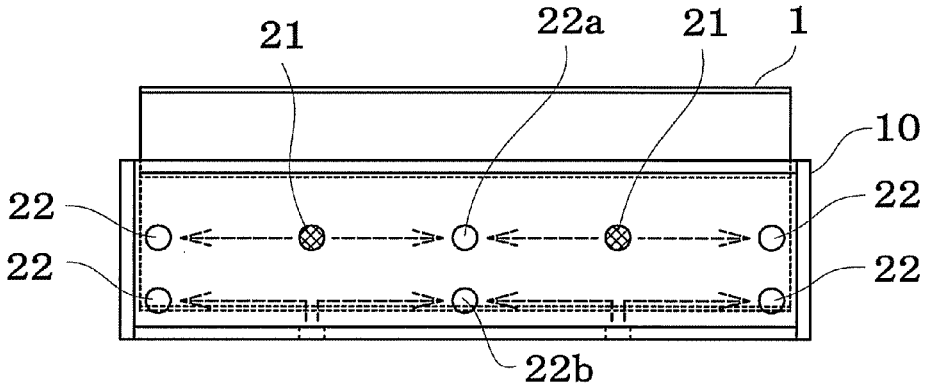
Figure 1A:
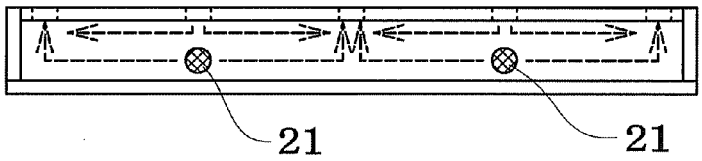
Figure 4A:
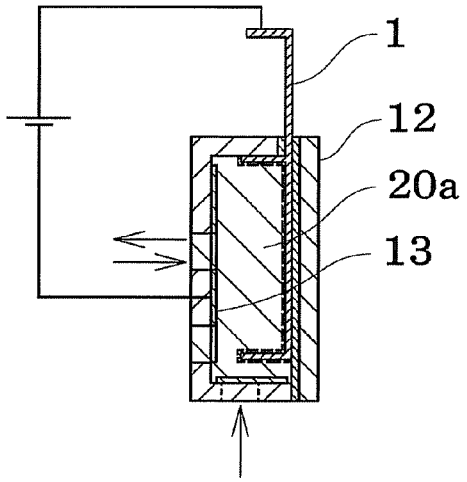
FIG. 4A illustrates a state in which a profile is anodized.
Figure 4B:
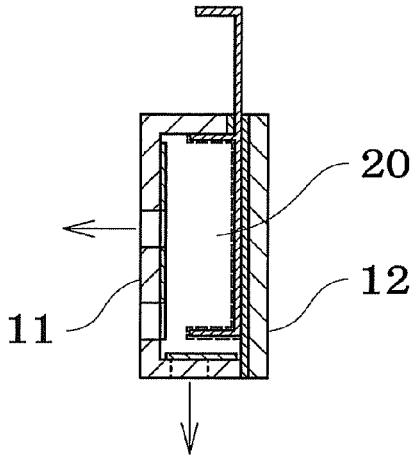
FIG. 4B illustrates a state in which an electrolyte solution 20*a* is drained after anodizing.
Figure 4C:
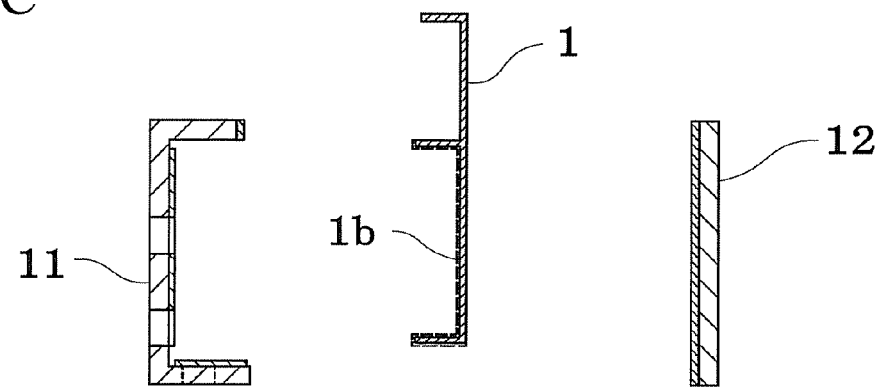
FIG. 4C illustrates a state in which a profile has been removed.

FIGS. 1A and 4C illustrate an example of the structure of a partial anodizing apparatus according to one embodiment of the invention.

An electrolytic bath 10 can be divided into a first partial bath 11 and a second partial bath 12, the first partial bath 11 having an approximately box-like shape, and being formed of an insulating material, a cathode 13 being disposed on the inner side of the first partial bath 11, and the second partial bath 12 having an approximately plate-like shape, and being formed of an insulating material.

In one embodiment of the invention, a profile 1 is held between one end 11*a* of the first partial bath 11 and the second partial bath 12. Seal members 11*c* and 12*a* are provided to come in contact with the profile 1.

An end 11*b* of the first partial bath 11 is situated opposite to the second partial bath 12 through the seal member 12*a*.

Part of the profile 1 that does not form a design surface (i.e., a part 1*a* for which an anodic oxide coating is unnecessary) is sealed with the second partial bath 12.

An electrolyte solution is introduced into an electrolysis chamber 20 through an inlet 21, and drained through an outlet 22.

The electrolyte solution drained through the outlet 22 is cooled using a cooler or the like, and re-introduced into the electrolysis chamber 20 through the inlet 21 using a circulation device such as a pump.

A plurality of inlets 21 are provided at equal intervals so that the electrolyte solution is uniformly discharged toward the profile 1. A plurality of outlets 22 are provided at equal intervals between the corner of the electrolysis chamber and the inlet 21 so that the electrolyte solution does not remain at the corner of the electrolysis chamber 20.

Anodizing, corrosion resistance, and the like were evaluated as described below using the electrolytic bath.

An aluminum alloy extruded profile was degreased, and subjected to an etching pretreatment according to a normal method. The extruded profile was then anodized in an electrolysis chamber having a given volume using a 200 g/l sulfuric acid aqueous solution as the electrolyte solution for a given time at a given current density.

The temperature of the electrolyte solution is preferably set to 15 to 25° C. so that a hard anodic oxide coating is not formed from the viewpoint of design.

Figure 2A:
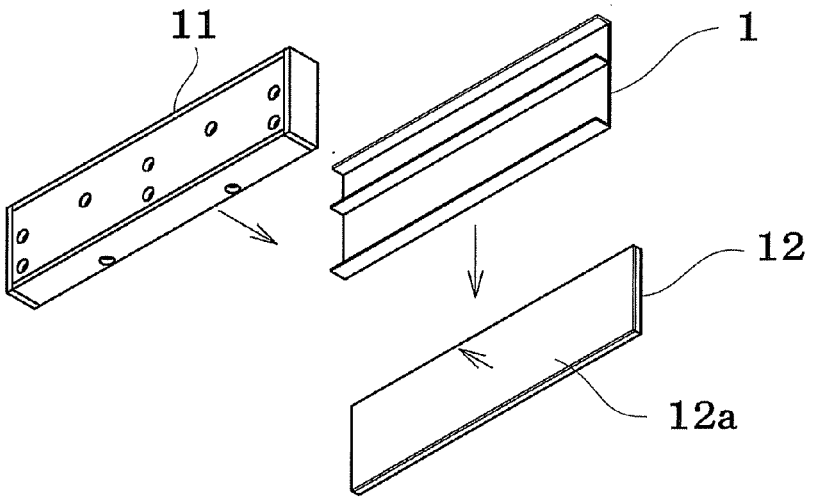
FIG. 2A illustrates a state in which two partial baths are separated.
Figure 2B:
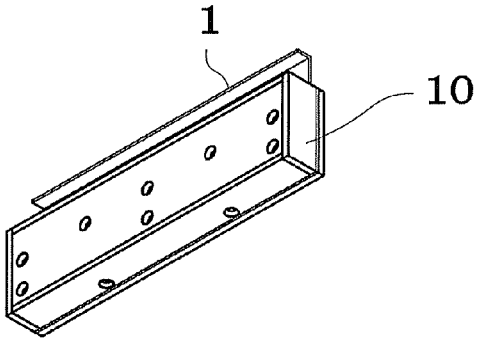
FIG. 2B illustrates a state in which an electrolysis chamber is formed so that a profile is placed therein.
Figure 2C:
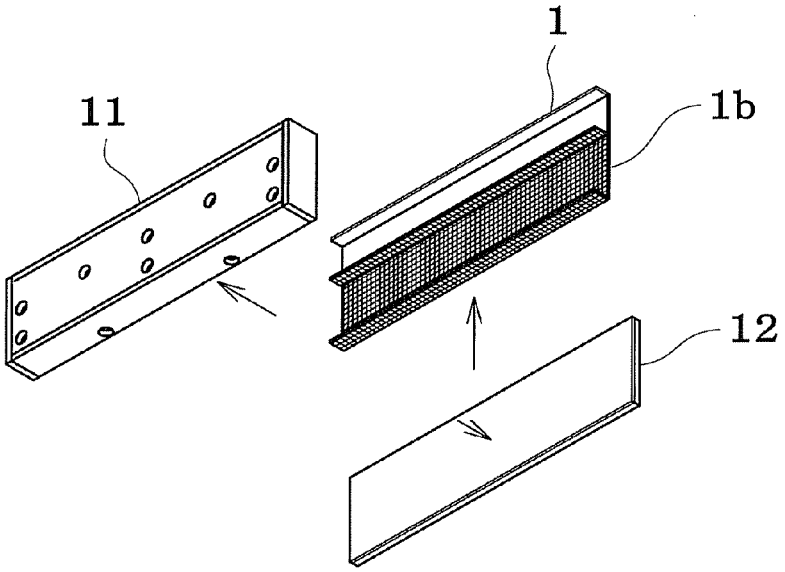
FIG. 2C illustrates a state in which a partially anodized profile has been removed.
Figure 3A:
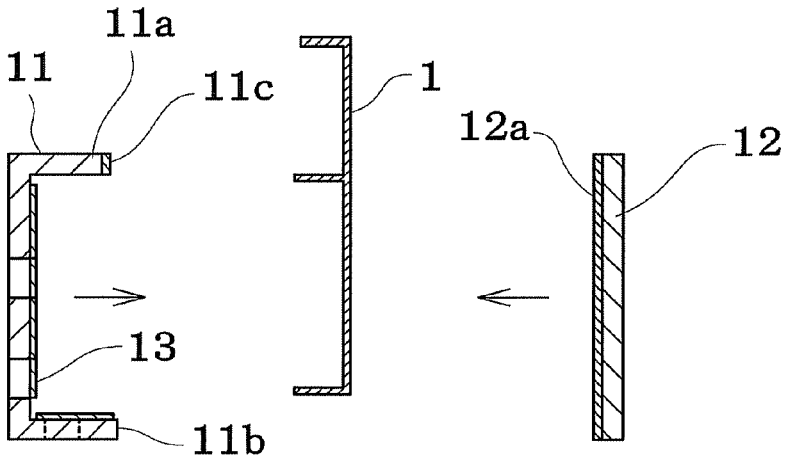
FIG. 3A is a cross-sectional view illustrating a state before an electrolytic bath is assembled.
Figure 3B:
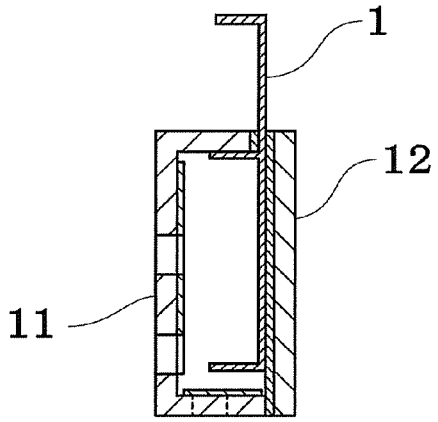
FIG. 3B illustrates a state after an electrolytic bath has been assembled.

As illustrated in FIG. 2A, the profile 1 was positioned between the first partial bath 11 and the second partial bath 12 so that part of the profile 1 was situated outside the electrolytic bath, and the first partial bath 11 and the second partial bath 12 were assembled as illustrated in FIG. 2B (see also FIGS. 3A and 3B).

Figure 3C:
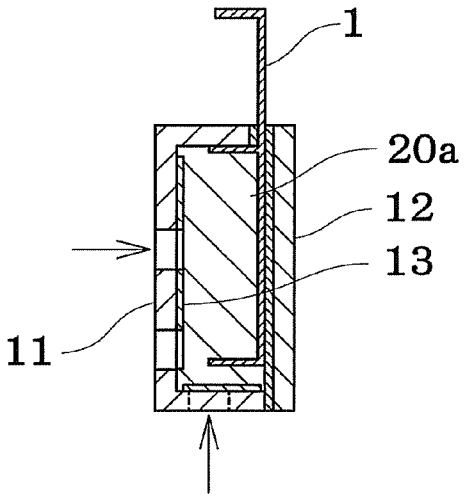
FIG. 3C illustrates a state in which an electrolysis chamber is filled with an electrolyte solution.

FIG. 3C illustrates a state in which the electrolytic bath was filled with the electrolyte solution 20*a*.

The electrolyte solution that was drained through each outlet 22 was discharged toward the profile 1 through each inlet 21 using a circulation device (not illustrated in the drawings) (see the arrows in FIGS. 1B and 1C).

The electrolysis chamber and the circulation device were connected through a pipe or the like (not illustrated in the drawings).

As illustrated in FIG. 4A, a voltage was applied between the profile 1 (anode) and the cathode 13 to effect electrolysis.

Either direct-current electrolysis or alternating-current electrolysis may be employed. In the examples, direct current was applied.

As illustrated in FIG. 4C, the electrolytic bath 10 was divided into two section after completion of electrolysis, and the profile 1 was removed.

An anodic oxide coating lb had been formed on part of the profile 1.

The profile 1 was then washed with water, and subjected to a boiling water sealing treatment for 20 minutes.

FIG. 5 shows the results of a Corrodkote test performed in accordance with JIS H 8502 ("Methods of corrosion resistance test for metallic coatings").

In Examples 1 and 2, a profile having a length of 250 mm was used. In Example 1, the volume of the electrolysis chamber was 0.4 l, the circulation flow rate of the electrolyte solution was 40 l/min, and the profile was anodized for 4 minutes at a current density of 10 A/dm$^2$.

In Example 2, the profile was anodized in the same manner as in Example 1, except that the current density was set to 8 A/dm$^2$.

In Example 3, the volume of the electrolysis chamber was 1.3 l, and a profile having the same cross-sectional shape as that of the profile used in Examples 1 and 2, and having a length of 800 mm was used.

The treatment conditions are shown in FIG. 5.

In Comparative Example 1, the outlets 22*a* and 22*b* were closed. In Comparative Example 2, the flow rate of the electrolyte solution was reduced.

In Examples 1 to 3, the profile had an excellent surface, and the corrosion ratio determined by the Corrodkote test was 10% or less.

In Comparative Example 1, the electrolyte solution stagnated, and local burning occurred. In Comparative Example 2, the value 30V (V: flow rate (1/min)) was smaller than the value 22SJ (S: treatment area (dm$^2$), J: current density (A/dm$^2$)), and burning occurred.

INDUSTRIAL APPLICABILITY

The invention is suitable for forming an anodic oxide coating on part of an extruded profile formed of a light alloy, and various products can be produced using an extruded profile obtained by such a treatment.

The invention claimed is:

1. A partial anodizing method that partially anodizes an extruded profile having an irregular cross-sectional shape, the method comprising:

providing an electrolytic bath that includes:

a first partial bath member having an approximately box shape that includes a bottom wall and a sidewall, and being formed of an insulating material, a cathode disposed on an inner side of the first partial bath member, a second partial bath member having an approximately plate shape, and being formed of an insulating material, disposing a first part of the extruded profile on the second partial bath member by way of a seal member, the first part being a first non-anodizing part;

joining the first partial bath member and the second partial bath member so that:

the extruded profile is sandwiched between the sidewall of the first partial bath member and the seal member formed on the second partial bath member so that a second part of the extruded profile is situated outside an area of the electrolytic bath at which the first partial bath member and the second partial bath member are overlapped with one another in a plan view, the second part being a second non-anodizing part, and an electrolysis chamber having inlets and outlets for an electrolyte solution is formed by the joining of the first partial bath member and the second partial bath member;

discharging the electrolyte solution through the inlets; and partially anodizing the extruded profile at locations where a design surface of the extruded profile comes into contact with the electrolyte solution by applying a voltage between the extruded profile as an anode and the cathode while anodizing is not occurring at the first and second non-anodizing parts with which the electrolyte solution does not come into contact.

2. The partial anodizing method as defined in claim 1, the extruded profile being anodized so that $22SJ<30V$ is satisfied, S being a treatment area ($dm^2$) in which the extruded profile is partially anodized, J being an electrolysis current density ($A/dm^2$), and V being a flow rate (l/min) of the electrolyte solution that is circulated through the electrolysis chamber.

* * * * *